US008417174B2

(12) United States Patent
Yamazaki et al.

(10) Patent No.: US 8,417,174 B2
(45) Date of Patent: Apr. 9, 2013

(54) SHEET FEEDING DEVICE AND IMAGE FORMING APPARATUS INCORPORATING SAME

(75) Inventors: Tomoyoshi Yamazaki, Mino (JP); Haruyuki Honda, Mino (JP); Hiroshi Fujiwara, Ikeda (JP); Kazuyoshi Kondo, Fuchu (JP); Toshikane Nishii, Ikeda (JP); Mizuna Tanaka, Ikeda (JP)

(73) Assignee: Ricoh Company Limited, Tokyo (JP)

( * ) Notice: Subject to any disclaimer, the term of this patent is extended or adjusted under 35 U.S.C. 154(b) by 494 days.

(21) Appl. No.: 12/659,103

(22) Filed: Feb. 25, 2010

(65) Prior Publication Data

US 2010/0221051 A1 Sep. 2, 2010

(30) Foreign Application Priority Data

Feb. 27, 2009 (JP) ..... 2009-046223

(51) Int. Cl.
*G03G 15/00* (2006.01)
*B65H 1/00* (2006.01)
*B65H 1/04* (2006.01)

(52) U.S. Cl.
USPC ..... 399/393; 271/145

(58) Field of Classification Search ..... 399/393; 271/145
See application file for complete search history.

(56) References Cited

U.S. PATENT DOCUMENTS 5,219,154 A 6/1993 Fukube et al.
5,316,282 A 5/1994 Fukube et al.
5,322,269 A 6/1994 Fukube et al.
5,405,128 A 4/1995 Fujiwara et al.
5,758,250 A * 5/1998 Miki ..... 399/393
6,916,019 B2 * 7/2005 Takahashi ..... 271/145
7,527,258 B2 * 5/2009 Ito ..... 271/145
2005/0141932 A1 * 6/2005 Sugiyama ..... 399/328
2007/0172255 A1 7/2007 Nanno et al.

(Continued)

FOREIGN PATENT DOCUMENTS

JP 06135571 A * 5/1994
JP 07157100 A * 6/1995

(Continued)

OTHER PUBLICATIONS

English language abstract of JP 09-309628, Dec. 2, 1997, Japan.

(Continued)

*Primary Examiner* — Matthew G Marini
*Assistant Examiner* — Nguyen Q Ha
(74) *Attorney, Agent, or Firm* — Harness, Dickey & Pierce, P.L.C.

(57) ABSTRACT

A sheet feeding device includes a sheet feed cassette, a bottom plate and an end wall mechanism. When the number of recording media sheets decreases, the bottom plate hinged at a trailing edge thereof rises about the hinged end to keep the top sheet of the recording media sheets in contact with a sheet feed roller. The end wall mechanism includes a first urging member, a first pressing member, a support member, and a second pressing member, and aligns and presses the trailing edge of the recording medium. The first pressing member urged by the first urging member and supported by the support member presses the trailing edge of the recording medium. The second pressing member urged by the second urging member moves down due to the weight of the recording medium on the second pressing member and moves up when the number of the recording media sheets decreases.

13 Claims, 3 Drawing Sheets

U.S. PATENT DOCUMENTS

| | | | |
|---|---|---|---|
| 2007/0273085 | A1 | 11/2007 | Nanno et al. |
| 2008/0054554 | A1 | 3/2008 | Nishii et al. |
| 2008/0143046 | A1 | 6/2008 | Nishii et al. |
| 2008/0174065 | A1 | 7/2008 | Kita et al. |
| 2008/0224385 | A1 | 9/2008 | Takahira et al. |
| 2008/0237970 | A1 | 10/2008 | Tanaka et al. |
| 2008/0273908 | A1 | 11/2008 | Ohkubo et al. |
| 2008/0284090 | A1 | 11/2008 | Honda et al. |
| 2009/0110459 | A1 | 4/2009 | Honda et al. |
| 2009/0315250 | A1 | 12/2009 | Kimura et al. |

FOREIGN PATENT DOCUMENTS

| | | | | |
|---|---|---|---|---|
| JP | 08133492 | A | * | 5/1996 |
| JP | 08324804 | A | * | 12/1996 |
| JP | 09118439 | A | * | 5/1997 |
| JP | 09142674 | A | * | 6/1997 |
| JP | 10129852 | A | * | 5/1998 |
| JP | 11116073 | A | * | 4/1999 |
| JP | 11165885 | A | * | 6/1999 |
| JP | 2002255358 | A | * | 9/2002 |
| JP | 3568139 | | | 6/2004 |
| JP | 2004196436 | A | * | 7/2004 |
| JP | 3788516 | | | 4/2006 |
| JP | 2006335502 | A | * | 12/2006 |
| JP | 2007030995 | A | * | 2/2007 |
| JP | 2008114997 | A | * | 5/2008 |
| JP | 2009023803 | A | * | 2/2009 |

OTHER PUBLICATIONS

English language abstract of JP 2005-263497, Sep. 29, 2005, Japan.

* cited by examiner

SHEET FEEDING DEVICE AND IMAGE FORMING APPARATUS INCORPORATING SAME

CROSS-REFERENCE TO RELATED APPLICATIONS

This patent application is based on and claims priority pursuant to 35 U.S.C. §119 from Japanese Patent Application No. 2009-046223, filed on Feb. 27, 2009 in the Japan Patent Office, which is hereby incorporated herein by reference in its entirety.

BACKGROUND OF THE INVENTION

1. Field of the Invention

Exemplary aspects of the present invention generally relate to an image forming apparatus, such as a copier, a facsimile machine, a printer, or a multi-functional system including at least two of these functions thereof, and more particularly, to a sheet feeding device employed in an image forming apparatus.

2. Description of the Background Art

An image forming apparatus such as a copier, a facsimile machine, a printer, or a multi-functional system including at least two of these functions also includes a sheet feeding device that stores multiple recording media sheets and feeds the recording media sheets one sheet at a time from the top. The sheet feeding device is generally equipped with a sheet feed tray or a sheet feed cassette in which the recording media sheets are stacked, such that a front portion of the sheet stack is placed on a bottom plate that pushes the sheet bundle upward by rotating about a shaft. The recording media sheets thus raised are then fed onward one sheet at a time from the top of the stack.

In such a sheet feeding device that stacks multiple recording media sheets, as the front portion of the sheet stack is raised, an angle of rotation of the bottom plate from the fulcrum thereof increases, thereby increasing the moving distance of a leading edge portion of the bottom plate in the vertical direction. The system is configured so that the rise of the bottom plate is restrained by the weight of the stack of sheets in the tray or cassette. However, when the number of recording media sheets stacked in the tray or cassette decreases that pressure also decreases, and thus the bottom plate rises still more.

As a result, a distance between the leading edge portion of the bottom plate and an end plate that pushes the trailing edge of the recording media sheets in a sheet feed direction increases, in contrast to a case in which there are multiple recording media sheets on the bottom plate, thus pushing down on the bottom plate. This increase in distance causes the leading edge of the recording medium in the sheet feed direction to retract, preventing a sheet feed roller from contacting the recording medium and thus failing to feed the sheet onward.

To counteract such a difficulty, the end plate is employed so that, regardless of the number of recording media sheets in the tray or cassette, the recording media sheets are pushed to the front of the tray or cassette in the sheet feed direction, thereby aligning the leading edges of the recording media sheets and enabling the sheet feed roller to contact the sheets for reliable sheet feeding operation.

When multiple recording media sheets are stacked on the bottom plate and thus the retraction of the recording media sheet at the leading edge of the bottom plate is insignificant, the end plate does not need to push the trailing edge of the recording media sheets stacked in the sheet feed tray or cassette in the sheet feed direction. However, despite this fact, in related-art approaches the end plate is designed to always push the trailing edge of the recording media sheets in the sheet feed direction regardless of the number of recording media sheets.

With this configuration, when multiple recording media sheets are stacked on the bottom plate, an angle between the bottom plate and a front wall of the sheet feed tray or cassette which the leading edge of the recording media sheets abuts is substantially perpendicular, compared to a case in which the number of stacked recording media sheets is low. As a result, due to the pressure of the end plate, the recording medium is sandwiched and squeezed between the end plate and the front wall at the leading edge side of the bottom plate. Consequently, in such a state, the resilience of the recording media sheets reduces the pressure of bottom plate pressing the sheet feed roller for feeding the recording media sheet, causing a problem in sheet feeding operation.

SUMMARY OF THE INVENTION

In view of the foregoing, in one illustrative embodiment of the present invention, a sheet feeding device for feeding a sheet of recording medium from a top of a stack of recording media sheets includes a sheet feed cassette, a bottom plate, and an end wall mechanism. The sheet feed cassette includes an opening at the top thereof to accommodate the recording media sheets. The bottom plate is disposed at the bottom of the sheet feed cassette and hinged at a trailing edge thereof in a sheet feed direction. A tip portion of the bottom plate in the sheet feed direction is vertically rotatable about the hinged end. The end wall mechanism aligns the trailing edge of the recording medium in the sheet feed direction. The end wall mechanism includes a first urging member disposed substantially at the back of the end wall mechanism, a first pressing member that presses the trailing edge of the recording medium in the sheet feed direction when pushed by the first urging member, a support member that rotatably supports the first pressing member relative to the pressure of the first urging member, and a second pressing member that is disposed substantially at the bottom of the end wall mechanism at the trailing edge of the sheet feed direction and moves downward due to the weight of the recording medium placed on the second pressing member. The second pressing member includes a second urging member that pushes the second pressing member upward from the trailing edge of the sheet feed direction. When the second pressing member is at a lower position, the first pressing member retracts to a position at which the first pressing member does not press the trailing edge of the recording medium relative to the pressure of the first urging member.

In another illustrative embodiment of the present invention, an image forming apparatus includes an image forming device, a transfer device, a fixing device, and a sheet feeding device. The image forming device forms an image. The transfer device transfers the image onto the recording medium. The fixing device fixes the image on the recording medium. The sheet feeding device feeds a sheet of recording medium from a top of a stack of recording media sheets to the image forming device and includes a sheet feed cassette, a bottom plate, and an end wall mechanism. The sheet feed cassette includes an opening at the top thereof to accommodate the recording media sheets. The bottom plate is disposed at the bottom of the sheet feed cassette and hinged at a trailing edge thereof in a sheet feed direction. A tip portion of the bottom plate in the sheet feed direction is vertically rotatable about the hinged end. The end wall mechanism aligns the trailing edge of the recording medium in the sheet feed direction. The end wall mechanism includes a first urging member disposed substantially at the back of the end wall mechanism, a first pressing member that presses the trailing edge of the recording medium in the sheet feed direction when pushed by the first urging member, a support member that rotatably supports the first pressing member relative to the pressure of the first urging member, and a second pressing member that is disposed substantially at the bottom of the end wall mechanism at the trailing edge of the sheet feed direction and moves downward due to the weight of the recording medium placed on the second pressing member. The second pressing member includes a second urging member that pushes the second pressing member upward from the trailing edge of the sheet feed direction. When the second pressing member is at a lower position, the first pressing member retracts to a position at which the first pressing member does not press the trailing edge of the recording medium relative to the pressure of the first urging member.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
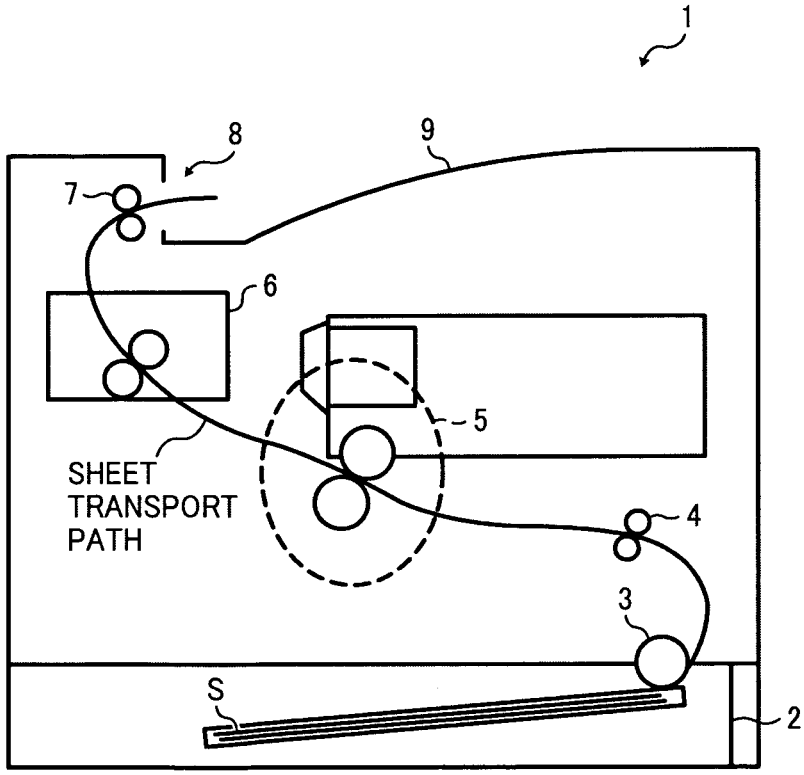
FIG. 1 is a cross-sectional schematic view of a printer as one example of an image forming apparatus according to an illustrative embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity of drawings and descriptions, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus according to an illustrative embodiment of the present invention is described.

Referring now to FIG. 1, there is provided a cross-sectional schematic view illustrating a printer as an example of the image forming apparatus according to the illustrative embodiment.

In FIG. 1, the image forming apparatus 1 includes a sheet feeding device 2, a sheet feed roller 3, a registration roller 4, an image forming device 5, a fixing device 6, a sheet discharge roller 7, a sheet discharge opening 8, and a sheet discharge tray 9.

In the image forming apparatus 1, a top sheet of recording media sheets S set in the sheet feeding device 2 is picked up and fed by the sheet feed roller 3 to the registration roller 4 one sheet at a time. The recording medium S is transported to the image forming device 5 through the registration roller 4, and an image is transferred onto the recording medium S. Although not illustrated, the image forming device 5 includes a photoreceptor, a transfer roller, and so forth.

After the image is transferred onto the recording medium S, the image is fixed by the fixing device 6. The recording medium S is then discharged from the sheet discharge opening 8 onto the sheet discharge tray 9 by the sheet discharge roller 7.

Figure 2:
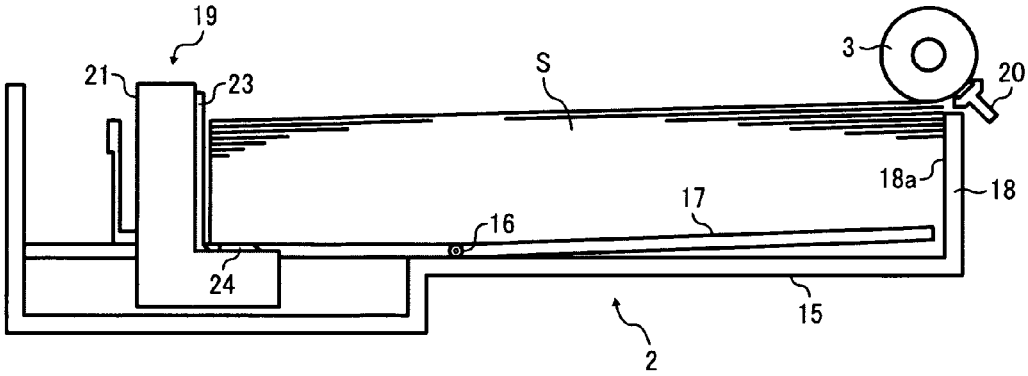
FIG. 2 is a cross-sectional schematic view of a sheet feeding device according to an illustrative embodiment of the present invention.
Figure 3:
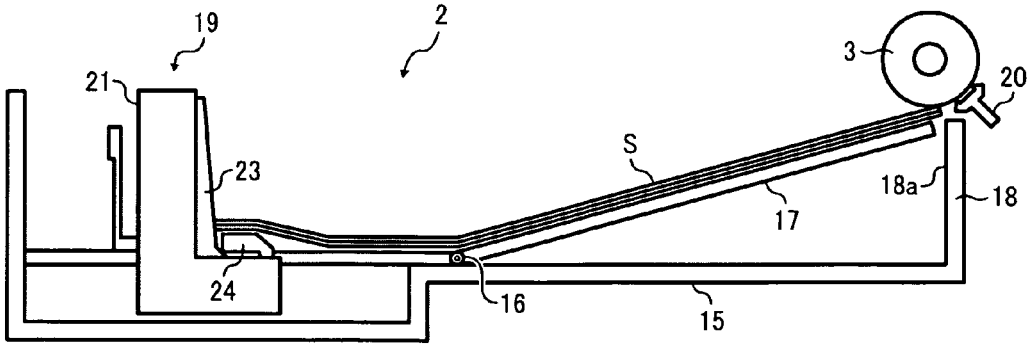
FIG. 3 is a cross-sectional schematic view for explaining a sheet pick up mechanism and sheet setting operation.
Figure 4C:
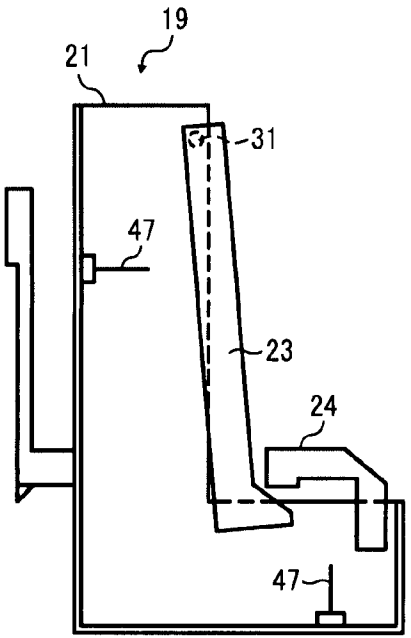
FIGS. 4A, 4B, and 4C are cross-sectional schematic views of an end wall mechanism according to the illustrative embodiment of the present invention.
Figure 4B:
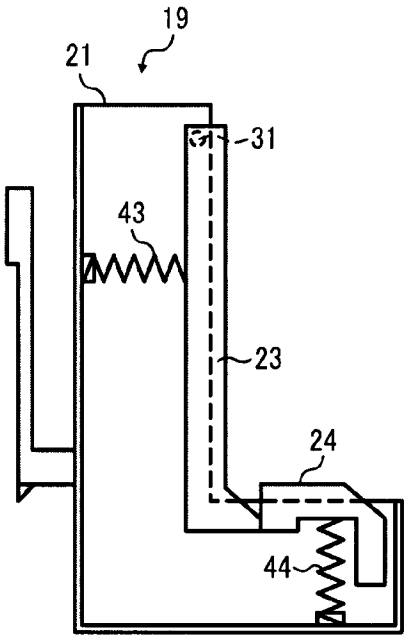
Figure 4A:
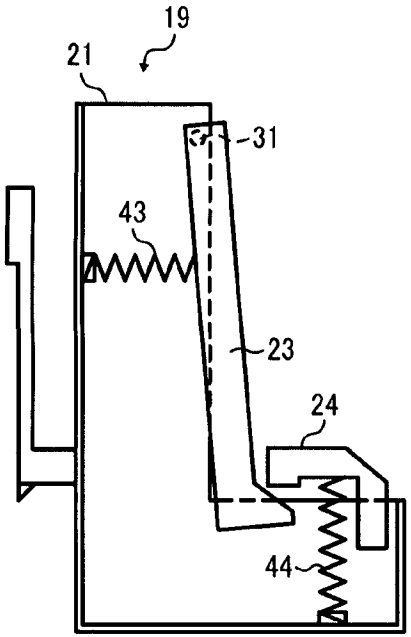

With reference to FIGS. 2, 3, and 4A through 4C, a description is now provided of the sheet feeding mechanism according to the illustrative embodiment of the present invention. FIG. 2 is a cross-sectional schematic view of the sheet feeding device 2. FIG. 3 is a cross-sectional schematic view for explaining a sheet pick up mechanism and sheet setting operation. FIGS. 4A through 4C are cross-sectional schematic views of an end wall mechanism according to the illustrative embodiment of the present invention.

The sheet feeding device 2 includes a sheet feed cassette 15, a bottom plate 17, a front wall 18, an end wall mechanism 19, a separation pad 20, and so forth. The sheet feed cassette 15 has a box shape, and the upper portion thereof is opened to accommodate the recording media sheets S. The front wall 18 includes a sheet regulating portion 18*a* that aligns the leading edge portion of the recording medium S in the sheet feed direction.

As will be later described, the end wall mechanism 19 aligns the trailing edge portion of the recording medium S. The separation pad 20 contacts the peripheral surface of the sheet feed roller 3 to frictionally separate the recording medium S and feed the recording medium S to the registration roller 4.

The bottom plate 17 is hinged at a trailing edge thereof in the sheet feed direction and vertically rotatable about a shaft 16. The bottom plate 17 includes a spring, not illustrated, that urges the bottom plate 17 upward enabling the bottom plate 17 to rotatably move upward, thereby causing the leading edge portion of the recording medium S on the bottom plate 17 to contact the peripheral surface of the sheet feed roller 3.

The end wall mechanism 19 includes a support member 21, a pressing member 23 serving as a first pressing member, a coil spring 43 serving as a first urging member that urges the pressing member 23, a pressing member 24 serving as a second pressing member, and a coil spring 44 serving as a second urging member that urges the pressing member 24.

The end wall mechanism 19 is slidably movable in the sheet feed direction so that paper in different sizes can be accommodated. The urging members such as the coil spring 43 and 44 are not limited to coil springs. Any other suitable urging members can be used. The pressing member 23 and the pressing member 24 constitute independent members.

As illustrated in FIGS. 4A and 4B, the pressing member 23 is a plate member and rotatably mounted to the support member 21 of the end wall mechanism 19. The pressing member 23 is rotatable about a shaft 31. The direction of rotation of the pressing member 23 coincides with the sheet feed direction of the recording medium S stored in the sheet feed sheet feed cassette 15.

When the pressing member 23 rotatably moves to the front in the sheet feed direction of the recording medium S, that is, toward the sheet regulating portion 18*a*, an outer surface of the pressing member 23 which is a surface facing the sheet regulating portion 18*a*, projects from the support member 21.

It is to be noted that the shaft 31 and the pressing member 23 constitute a single integrated member which is fitted with a mounting hole, not illustrated, formed at the support member 21.

One end of the urging member, that is, the coil spring 43 pressing the pressing member 23, is attached to a peripheral portion of the support shaft 47 (shown in FIG. 4C). The support shaft 47 is fixed to the inner surface of the support member 21. The support shaft 47 projects toward the pressing member 23. FIG. 4C is a cross-sectional schematic view illustrating the end wall mechanism when the coil springs 43 and 44 are removed.

The other end of the coil spring 43 presses the inner surface of the pressing member 23, thereby enabling the pressing member 23 to rotatably move to the front in the sheet feed direction.

The pressing member 24 serving as a second pressing member is disposed substantially in proximity of the bottom of the pressing member 23 at the sheet regulating portion 18*a* side. The pressing member 24 is slidably provided to the support member 21 so as to slide up and down.

One end of the coil spring 44 that urges the pressing member 24 is attached to a support shaft 47 (shown in FIG. 4C) fixed to the bottom surface of the support member 21. The other end of the coil spring 44 contacts the inner surface of the pressing member 24, thereby enabling the pressing member 24 to slidably move upward.

When the pressing member 24 is substantially at the upper position as illustrated in FIG. 4A, the pressing member 24 does not contact the pressing member 23. Thus, the pressing member 23 operates independently of the pressing member 24.

By contrast, when some weight is applied on the pressing member 24 so that the pressing member 24 is at the lower position as illustrated in FIG. 4B, the pressing member 24 contacts and presses a portion of the pressing member 23, causing the pressing member 23 to rotate (retract) in the direction opposite the sheet feed direction. In this state, the pressing member 23 is at a retracting position.

When multiple recording media sheets S are set in the sheet feed cassette 15, the pressing member 24 moves downward against the pressure of the coil spring 44 due to the weight of the recording media sheets S. Consequently, the pressing member 24 presses the pressing member 23, causing the pressing member 23 to rotatably move against the pressure of the coil spring 43. As a result, the pressing member 23 does not urge the recording media sheets S.

With this configuration, when a number of the recording media sheets S in the sheet feed cassette 15 decreases, the bottom plate 17 rotatably moves upward about the shaft 16 to keep the top sheet of the recording medium in contact with the peripheral surface of the sheet feed roller 3 while the pressing member 24 slidably moves upward, separating from the pressing member 23. Accordingly, the bottom end portion of the pressing member 23 urged by the coil spring 43 rotatably moves to the front in the sheet feed direction about the shaft 31 substantially at the upper portion of the pressing member 23. The bottom end portion of the pressing member 23 is lifted up by a small amount, thereby pushing the recording medium to the front in the sheet feed direction and reliably feeding the recording medium S.

Furthermore, as illustrated in FIG. 3, when the number of the recording media sheets in the sheet feed cassette 15 decreases significantly from the initial amount, the bottom plate 17 rises by a large amount compared with the case in which a large number of the recording media sheets are stored in the sheet feed cassette 15 as illustrated in FIG. 2. With this configuration, even if the pressing member 23 is urged, the recording media sheets are not squeezed undesirably between the pressing member 23 and the front wall 18. In such a state, the resilience of the recording media sheets does not cause reduction in the pressure of the bottom plate 17 pushing the recording media sheets against the sheet feed roller 3.

As described above, when the recording media sheets S on the bottom plate 17 are pushed forward in the sheet feed direction, the leading edge portion of the recording media sheets S is reliably aligned. When the number of the recording media sheets decreases and the bottom plate 17 moves upward, the sheet feed roller 3 remains in continuous contact with the top sheet of the recording medium. Accordingly, the recording media sheets S are fed until the very last sheet.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A sheet feeding device for feeding a sheet of recording medium from a top of a stack of recording medium sheets, comprising:

a sheet feed cassette including an opening at the top thereof to accommodate the recording medium sheets;

a bottom plate disposed at the bottom of the sheet feed cassette, hinged at a trailing edge thereof in a sheet feed direction, a tip portion of the bottom plate in the sheet feed direction vertically rotatable about the hinged end; and an end wall mechanism to align the trailing edge of the recording medium sheet in the sheet feed direction, the end wall mechanism including:

a first urging member disposed substantially at the back of the end wall mechanism;

a first pressing member to press the trailing edge of the recording medium sheet in the sheet feed direction when pushed by the first urging member;

a support member to rotatably support the first pressing member relative to the pressure of the first urging member; and a second pressing member disposed substantially at the bottom of the end wall mechanism at the trailing edge of the sheet feed direction, to move downward due to the weight of the recording medium sheet placed on the second pressing member, the second pressing member including a second urging member that pushes the second pressing member upward from the trailing edge of the sheet feed direction, wherein the first pressing member and the second pressing member constitute independent members, and wherein when the second pressing member is at a lower position, the first pressing member retracts to a position at which the first pressing member does not press the trailing edge of the recording medium sheet relative to the pressure of the first urging member.

2. The sheet feeding device according to claim 1, wherein one end of the second urging member is supported by the support member.

3. The sheet feeding device according to claim 1, wherein the end wall mechanism is slidably movable in the sheet feed direction.

4. The sheet feeding device according to claim 1, wherein when the second pressing member is at the lower position, at least a portion of the second pressing member pushes a portion of the first pressing member and the first pressing member retracts to the position at which the first pressing member does not push the trailing edge of the recording medium sheet.

5. The sheet feeding device according to claim 4, wherein when the second pressing member is at an upper position, the first pressing member and the second pressing member do not contact each other.

6. The sheet feeding device according to claim 1, wherein when the second pressing member is substantially at an upper position, the second pressing member does not contact the first pressing member.

7. The sheet feeding device according to claim 1, wherein the second pressing member presses the first pressing member to rotatably move against the pressure of the first urging member.

8. The sheet feeding device according to claim 1, wherein one end of the first urging member that presses the first pressing member thereto is attached to a first support shaft.

9. The sheet feeding device according to claim 8, wherein the first support shaft projects toward the first pressing member.

10. The sheet feeding device according to claim 1, wherein the second pressing member is slidably provided to the support member so as to slide up and down.

11. The sheet feeding device according to claim 10, wherein one end of the second urging member that presses the second pressing member thereto is attached to a second support shaft fixed to the bottom surface of the support member.

12. The sheet feeding device according to claim 11, wherein the other end of the second urging member contacts an inner surface of the second pressing member to enable the second pressing member to slidably move upward.

13. An image forming apparatus, comprising:

an image forming device to form an image;

a transfer device configured to transfer the image onto a recording medium;

a fixing device to fix the image on the recording medium; and a sheet feeding device to feed a sheet of recording medium from a top of a stack of recording medium sheets to the image forming device, the sheet feeding device including:

a sheet feed cassette including an opening at the top thereof to accommodate the recording medium sheets;

a bottom plate disposed at the bottom of the sheet feed cassette, hinged at a trailing edge thereof, a tip portion of the bottom plate in the sheet feed direction vertically rotatable about the hinged end;

an end wall mechanism disposed at the back of the sheet feed cassette in the sheet feed direction to align the trailing edge of the recording medium sheet, the end wall mechanism including:

a first urging member;

a first pressing member to press the trailing edge of the recording medium sheet in the sheet feed direction when pressed by the first urging member;

a support member to rotatably support the first pressing member relative to the pressure of the first urging member; and a second pressing member disposed substantially at the bottom of the end wall mechanism at the trailing edge of the sheet feed direction, to move downward due to the weight of the recording medium sheet placed on the second pressing member, the second pressing member including a second urging member that urges the second pressing member upward from the trailing edge of the sheet feed direction, wherein the first pressing member and the second pressing member constitute independent members, and wherein when the second pressing member is at a lower position, the first pressing member retracts to a position at which the first pressing member does not press the trailing edge of the recording medium sheet relative to the pressure of the first urging member.

* * * * *